United States Patent [19]

Moncrieff-Yeates

[11] 4,149,519

[45] Apr. 17, 1979

[54] FIREPLACE UNIT WITH ASH DISPOSAL DUCT

[76] Inventor: Alexander J. Moncrieff-Yeates, 8924 Rhyme Ct., Annandale, Va. 22003

[21] Appl. No.: 845,309

[22] Filed: Oct. 25, 1977

Related U.S. Application Data

[62] Division of Ser. No. 729,955, Oct. 6, 1976, Pat. No. 4,096,849.

[51] Int. Cl.[2] ..... F23J 1/00

[52] U.S. Cl. ..... 126/242

[58] Field of Search ..... 126/120, 121, 129, 130, 126/131, 143, 242, 243, 244, 245, 293

[56] References Cited

U.S. PATENT DOCUMENTS

| | | | |
|---|---|---|---|
| 2,375,318 | 5/1945 | Mudgett | 126/121 |
| 2,725,874 | 12/1955 | Payne | 126/121 |
| 3,096,754 | 7/1963 | Howrey | 126/120 |

*Primary Examiner*—Robert L. Wolfe

*Attorney, Agent, or Firm*—Sixbey, Friedman & Leedom

[57] ABSTRACT

A fireplace unit wherein room air is circulated under the firebox bed plate has an ash discharge chute which depends from the rear portion of the bed plate and registers with the conventional fireplace ash chute. The ash chute includes diametrically opposite openings in the respective front and rear walls which openings communicate with the room air passageway under the bed plate and permit flow of recirculating room air transversely through the ash chute.

5 Claims, 3 Drawing Figures

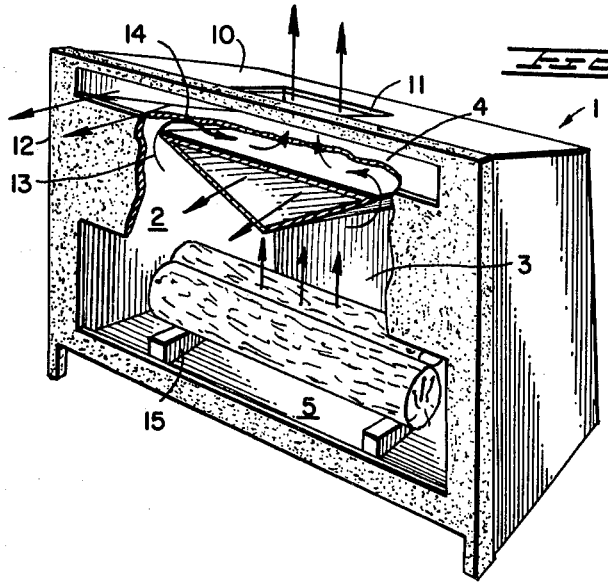
Fig 1
Fig 2.
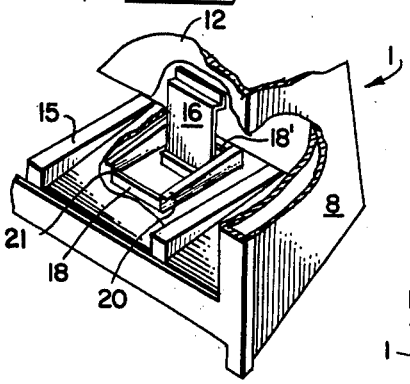
Fig 3.
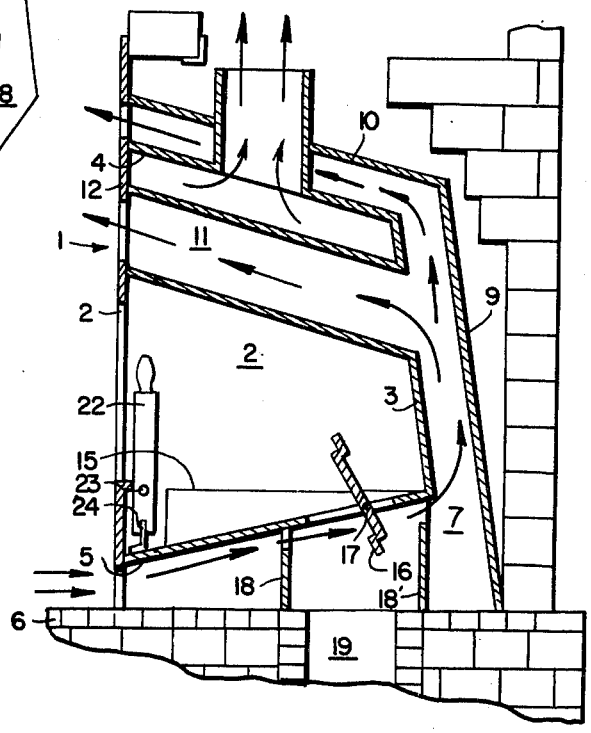

FIREPLACE UNIT WITH ASH DISPOSAL DUCT

RELATED APPLICATION

This application is a division of my copending application Ser. No. 729,955 filed Oct. 6, 1976 and now U.S. Pat. No. 4,096,849.

FIELD OF INVENTION

This invention relates to fireplace units of the recirculating room air type as exemplified by my co-pending application Ser. No. 570,798 (now U.S. Pat. No. 4,056,091 issued Nov. 1, 1977), by U.S. Pat. No. 2,642,859 issued June 23, 1953 to N. T. Brown, or to fireplaces including provision for heating air circulated in ducts leading to and from other points in a building, as seen in U.S. Pat. No. 3,096,754 issued July 9, 1963 to Harold C. Howrey.

BACKGROUND OF INVENTION

Previously known fireplace units which pull room air in under the fire enclosure bed are subject to the effects of radiation from the fire downwardly against the bed plate, recessitating the employment of a heavy construction which in turn adversely effects heat transfer. The thickness of the bed plate can be reduced somewhat by reason of reliance on the cooling effect of the underlying incoming room air. However, this cooling effect of incoming room air remains inefficient because of the relatively low velocity thereof and the uneven velocity pattern caused by any obstructions to air flow in the underlying passageway. This in turn, has a detrimental (in fact, dangerous) result that the bed plate becomes overheated in areas of low velocity or stagnation of air flow. Designers have resorted to extra thick bed plates in order to avoid burnouts, and thus have incurred additional cost in the construction of heavy units which increase shipping cost and render installation more difficult. Design has thus become a compromise between economy, light weight, and efficiency on one hand and safety and durability on the other.

It has also been recognized in the past that it is desireable to provide an ash transfer duct passing from the bed plate through the underlying room air passageway to a point of registry with the conventional ash chute of the fireplace hearth. However, in previously known structure, this duct completely isolates the bed plate in the area of the trap door for ashes from any heat exchange with the underlying room air and creates areas of low velocity or stagnation in the room air passageway surrounding the duct, thus increasing the likelihood of burn-out in that area.

OBJECTS OF THE INVENTION

In contradistinction to the aforedescribed previously known structures, the structure of this invention fulfills the objectives of providing a fireplace unit of the recirculating room air type in which 1. heat exchange through the bed plate is enhanced,
2. weight of the unit is materially reduced,
3. cost of materials is reduced,
4. an ash duct is provided which does not interfere significantly with room air recirculation, and
5. an ash duct is provided which avoids overheating of the portion of the bed plate overlying the duct.

DESCRIPTION OF DRAWINGS

The aforestated objects, as well as other objects inherent in the fireplace unit of this invention, will be apparent from a consideration of the ensuing specification and drawings, in which FIG. 1 is a perspective of a fireplace unit of the room air circulating type, FIG. 2 is a fragmentary perspective of the unit of FIG. 1 with a portion of the bottom cut away to reveal the ash chute detail, FIG. 3 is a cross-sectional view taken through the center of a fireplace including a unit of this invention.

DESCRIPTION OF THE INVENTION

Referring first to FIG. 1, this invention is depicted in a fireplace unit generally indicated at 1 which is of the type described and claimed in my aforementioned applications Ser. Nos. 570,798 and 729,955. In this unit, a fire enclosure is defined by side walls including wall 2, rear wall 3, top wall 4, and a bed plate 5 which differs from my prior application in that it slopes upwardly and rearwardly in accordance with this invention.

The fire enclosure is surrounded by passages through which room air is circulated in heat exchange relationship with the enclosure. These passages include a room air intake passage underlying the bed plate 5 and defined by the bed plate 5 and the fireplace hearth 6. Other passages in communication with the room air intake passage to complete the room air circulation system include the unit exterior side walls 7, 8, exterior rear wall 9, and exterior top wall 10. A duct 11 extending through the enclosure rear wall and through the facade 12 of the unit completes the room air passageway through the upper reaches of the fire enclosure. This duct and the specific geometry of the unit attain an enhanced heat exchange through the creation of a vortical flow pattern of hot combustion products in the areas indicated at 13 and 14 and fully described in my aforementioned pending application Ser. No. 570,798.

This particular fireplace unit is chosen for illustration here because of the importance in such a unit of channeling a substantial flow of room air to the rear passageway where it finds its way to the duct 11, but it should be recognized that this invention is equally applicable to fireplace units which are devoid of a duct such as a duct 11. In either event, it can be seen that the provision of a bed plate 5 which slopes upwardly in the direction of underlying room air flow enhances the intake of room air by permitting an upward component of convective flow in the area underlying the bed plate. The upward slope of the bed plate could take many forms, including portions sloping to each of the vertical passageways of the room air recirculating system. In the preferred embodiment illustrated, this upward slope is toward the rear vertical passageway for reasons now to be discussed. In the prior art where convective flow is limited to the surrounding vertical passages, and flow of the air underlying the horizontal bed plate is limited to that caused by the slight negative pressure developed by that convective flow in the vertical passages, there is a marked tendency for the room air to take the shortest path under the bed plate to the vertical passages at the sides of the fire enclosure, rather than the relatively long path to the vertical passage at the rear. Not only does this result in a disproportionate flow being diverted from the highly heated rear wall 3, but in a unit which includes a central duct 11 it is desireable to route a high percentage of the flow up the rear passageway in order to provide a higher percentage of flow through the duct 11. Thus, it can be seen that this bed plate 5 which slopes upwardly to the rear at a preferred angle of 15° of less accomplishes several objectives, namely: (1) increased total flow through unit by creating convective flow under the bed plate, (2) distribution of a greater percentage of total flow to the rear vertical passageway of the unit, (3) enhancement of heat exchange through the bed plate, and (4) facilily of use of lighter materials because of better heat exchange from the bed plate by virtue of the scrubbing action of the flowing incoming air.

In the latter regard, if the use of a lighter (i.e., thinner) bed plate is to be realized, it is essential that the scrubbing action of the underlying air be distributed over the entire bed plate surface. In units which include an ash chute, such as in Howrey U.S. Pat. No. 3,096,754, a problem is created by reason of the interference with this air flow by the duct itself. The result is a reduced velocity of underlying air flow and/or areas of air stagnation which create hot spots in the bed plate at the area of the ash chute. To the end that this problem may be avoided, this invention provides a conventional trap door 16 pivotally mounted as at 17 in an ash opening in the bed plate 5. The trap door 16 overlies a conventional ash receiving chamber 19 in the hearth 6, and ashes which are discharged through the trap door 16 are directed to the chamber 19 by a chute having front and rear walls 18,18' and side walls 21. The cross-sectional area, preferably in the distance between front wall 18 and rear wall 18', is greater than the cross-sectional area, preferably in the fore and aft dimension, of the trap door opening. The walls 18,18' terminate in an upper edge which is spaced from the bed plate 5. The side walls 21 extend upwardly to the bed plate 5 to provide a suspended mounting for the chute, and in the preferred construction illustrated are attached to the bed plate 5 by angle irons 20. The spaces between the upper edges of the front and rear walls 18,18' provides openings for incoming room air to flow as indicated by the arrow in FIG. 3. The side walls 21, being aligned with the direction of air flow, provide negligable interference with air flow. The aforementioned distance between the front and rear walls 18,18' exceeds the trap door dimension enough to avoid spillage of ash onto the hearth proper during ash discharge.

The bed plate 5 of this invention may appropriately be provided with grates 15 extending fore and aft of the fire enclosure and adapted to the contour of the bed plate. They present a generally horizontal upper surface for support of the fuel. Alternatively, the upper surface may be contoured sloping downwardly to the rear or concavely to have their lowest point in the center. When the grates 15 are rigidly attached to the bed plate to provide reinforcement thereto, it may be desirable to provide andirons, which are movable in a side-to-side direction of the fire enclosure to accomodate various lengths of logs and to facilitate cleaning. Yet, inasmuch as the grates are elevated considerably above the hearth lever, it is equally desireable that the andirons be firmly attached to the unit, as logs which might otherwise tumble from the grate would be likely to acquire sufficient momentum to cause them to roll beyond the hearth into the room. To this end, there is provided a horizontal rod 23 at a location between the grate and the fire enclosure opening and at a height approximately that of the top surface of the grate. Directly underlying the rod is a track 24, here shown as including an upstanding flange affixed to the bed plate 5. Each of two andirons 22 (omitted from FIG. 3 for purposes of clarity) comprise vertical tubular elements which include apertures for reception of the supporting rod 23 and a bifurcated lower extremety in registry with the guide track 24. It can be readily seen that each andiron 22 can be easily adjusted, and that once in position its weight and its frictional engagement with the rod and track 24 will hold it in position. The andirons are readily moveable to permit movement of ashes in front of the permanently affixed grates 15 during the process of discharge.

This invention has been described in its preferred embodiments in a fireplace for the purpose of compliance with 35 U.S.C. 112, it being readily understandable that the term "fireplace" is entitled to broad interpretation including integral units, inserts, or free standing units of types including a fire enclosure and utilizing solid fuel thus creating ashes, and whether used for space heating, central heating, cooking, or other specialized uses.

I claim:

1. In a fireplace unit of the type which includes a room air recirculating passageways including an incoming room air inlet opening into an inlet passageway underlying the bed plate of the fire enclosure, at least one vertical passageway defined in part by a wall of said fire enclosure, and an air outlet to a room, and wherein said bed plate includes a trap door for ash disposal, the improvement comprising an ash chute suspended from said bed plate in a position underlying said trap door, said chute including diametrically opposite walls having openings communicating with said room air inlet passageway in the direction of room air flow, said openings being disposed subjacent to the bed plate to permit flow of incoming room air transversely of said chute through both said openings.

2. A fireplace unit as set forth in claim 1 wherein said ash duct is constructed of front, rear, and side walls, and wherein the suspension of said chute is by said side walls being attached to the underside of the bed plate, and said openings are defined by termination of said side walls in an edge spaced below the bed plate.

3. A fireplace unit as set forth in claim 1 wherein the cross-sectional area of said duct exceeds the cross-sectional area of said trap door.

4. A fireplace unit as set forth in claim 2 wherein the fore and aft dimension of said duct exceeds the fore and aft dimension of said trap door.

5. In a fireplace unit of the type including a fire enclosure defined in part by a bed plate including a trap door for ash disposal, the inprovement comprising an ash chute suspended from said bed plate in a position underlying said trap door, said chute including diametrically opposite walls having openings communicating with said room air inlet passageway in the direction of room air flow, said openings being disposed subjacent to the bed plate to permit flow of incoming room air transversely of said chute through both said openings.

* * * * *